US009474936B2

(12) United States Patent
Weltha

(10) Patent No.: US 9,474,936 B2
(45) Date of Patent: Oct. 25, 2016

(54) SPINNING ROTATION AND MEDITATION SYSTEM, DEVICE AND METHOD

(71) Applicant: Weltha LLC, New York, NY (US)

(72) Inventor: Craig Weltha, New York, NY (US)

(73) Assignee: Weltha LLC, New York, NY (US)

( * ) Notice: Subject to any disclaimer, the term of this patent is extended or adjusted under 35 U.S.C. 154(b) by 17 days.

(21) Appl. No.: 14/213,126

(22) Filed: Mar. 14, 2014

(65) Prior Publication Data

US 2014/0295394 A1 Oct. 2, 2014

Related U.S. Application Data

(60) Provisional application No. 61/781,101, filed on Mar. 14, 2013.

(51) Int. Cl.

| | |
|---|---|
| ***G09B 19/00*** | (2006.01) |
| ***A63B 26/00*** | (2006.01) |
| ***A63B 1/00*** | (2006.01) |
| ***A63B 22/14*** | (2006.01) |
| ***A63B 22/18*** | (2006.01) |
| ***A63B 21/06*** | (2006.01) |
| ***A63B 21/068*** | (2006.01) |
| ***A63B 21/22*** | (2006.01) |
| *A63B 69/00* | (2006.01) |
| *A63B 21/16* | (2006.01) |
| *A63B 23/02* | (2006.01) |
| *A63B 22/00* | (2006.01) |

(52) U.S. Cl.

CPC ..... *A63B 26/003* (2013.01); *A63B 1/00* (2013.01); *A63B 21/0608* (2013.01); *A63B 21/068* (2013.01); *A63B 21/22* (2013.01); *A63B 22/14* (2013.01); *A63B 22/18* (2013.01); *A63B 21/16* (2013.01); *A63B 21/4034* (2015.10); *A63B 21/4035* (2015.10); *A63B 23/0222* (2013.01); *A63B 69/0057* (2013.01); *A63B 2022/0092* (2013.01); *A63B 2208/0204* (2013.01); *A63B 2208/029* (2013.01)

(58) Field of Classification Search

USPC ..... 434/247, 255; 482/140, 145, 146, 147

See application file for complete search history.

(56) References Cited

U.S. PATENT DOCUMENTS

| | | | | |
|---|---|---|---|---|
| 3,441,271 | A * | 4/1969 | Palacios | A63B 22/14 472/14 |
| 3,784,193 | A * | 1/1974 | Simjian | A63B 22/14 482/118 |
| 3,862,768 | A | 1/1975 | England | |
| 3,911,907 | A * | 10/1975 | Smith, Jr. | A61H 1/02 482/1 |
| 3,936,047 | A * | 2/1976 | Brandt | A61H 1/003 482/130 |
| 4,290,601 | A | 9/1981 | Mittelstadt | |
| 4,391,441 | A * | 7/1983 | Simjian | A63B 22/14 482/131 |
| 4,448,411 | A | 5/1984 | Parker | |
| 4,505,476 | A * | 3/1985 | Rubin | A63B 22/02 482/147 |
| 4,509,743 | A | 4/1985 | Lie | |
| 4,905,994 | A * | 3/1990 | Hartz | A63B 22/14 482/146 |

(Continued)

*Primary Examiner* — Kurt Fernstrom

(74) *Attorney, Agent, or Firm* — Davis, Brown, Koehn, Shors & Roberts, P.C.

(57) ABSTRACT

The disclosed device, system and methods relate to a spinning rotation and meditation device, having a rotating platform set at a nonzero angle from horizontal. Certain embodiments comprise a platform capable of rotation about a central hub which further comprises a plurality of legs, wherein the platform is set to rotate on a plane which is set at a non-zero angle from the horizon. Certain embodiments of the disclosed devices, systems and methods relate to the acquisition and practice of a centrifugal balance process, skill and ability.

14 Claims, 9 Drawing Sheets

(56) References Cited

U.S. PATENT DOCUMENTS 5,108,089 A * 4/1992 Wilkinson ..... A63B 23/0458 108/12
5,549,536 A 8/1996 Clark
5,766,119 A 6/1998 Clark
5,879,275 A * 3/1999 Aruin ..... A63B 22/14 482/146
5,941,807 A * 8/1999 Cassidy ..... A63B 22/14 482/130
6,019,712 A 2/2000 Duncan
6,176,817 B1 * 1/2001 Carey ..... A63B 22/18 482/146
6,413,197 B2 * 7/2002 McKechnie ..... A63B 22/18 482/127
6,419,586 B1 7/2002 Chiu
6,666,802 B1 12/2003 Rasmussen
6,790,166 B2 * 9/2004 Broudy ..... A63B 22/14 273/108.1
7,175,577 B2 * 2/2007 Greenspan ..... A61H 1/0237 482/146
7,374,522 B2 * 5/2008 Arnold ..... A63B 21/005 482/146
7,438,675 B2 * 10/2008 Lin ..... A63B 21/015 482/140
D593,170 S * 5/2009 Craig ..... D21/689
7,559,878 B2 7/2009 Hakooz
7,618,348 B2 11/2009 Hakooz
7,651,450 B2 * 1/2010 Wehrell ..... A61H 1/0229 482/124
7,753,831 B2 * 7/2010 Langer ..... A63B 21/0004 482/146
7,775,952 B1 8/2010 Curran
7,803,096 B2 * 9/2010 Mehta ..... A63B 22/14 482/112
8,057,362 B2 * 11/2011 Nadim ..... A63B 22/0017 482/146
8,435,164 B2 * 5/2013 VanBuren ..... A63B 26/003 482/145
8,998,784 B1 * 4/2015 Sloan ..... A63B 21/0085 482/142
2006/0211553 A1 9/2006 Cantor
2010/0144499 A1 * 6/2010 Graham ..... A63B 21/055 482/131
2014/0171266 A1 * 6/2014 Hawkins, III ..... A63B 24/0087 482/5

* cited by examiner

SPINNING ROTATION AND MEDITATION SYSTEM, DEVICE AND METHOD

CROSS-REFERENCE TO RELATED APPLICATION(S)

This application claims priority from U.S. Provisional Application 61/781,101, filed Mar. 14, 2013, and entitled "Spinning Rotation and Meditation Device and Method," which is hereby incorporated herein by reference in its entirety.

TECHNICAL FIELD

The disclosed devices, systems and methods relates to a rotation and balancing device, system and method.

BACKGROUND

The disclosed devices, systems and methods relates to a rotation and balancing device, system and method, which can be used for exercise, entertainment, meditation and other activities. The disclosure relates to the rotation and balancing device itself, and the systems and methods of using it.

While certain balancing platforms have been used for recreation in the past, none has been focused on the specific application of linear force and balance to achieve angular momentum in the manner described herein.

BRIEF SUMMARY

Discussed herein are various embodiments and implementations of rotation and balance device having a rotating platform set at a nonzero angle from the horizon so as to allow a user to translate linear motion into rotational motion or angular momentum so as to achieve rotation upon the platform. Many embodiments are possible.

While multiple embodiments are disclosed, still other embodiments of the disclosed devices, systems and methods will become apparent to those skilled in the art from the following detailed description, which shows and describes illustrative embodiments of the invention. As will be realized, the invention is capable of modifications in various obvious aspects, all without departing from the spirit and scope of the disclosed devices, systems and methods. Accordingly, the drawings and detailed description are to be regarded as illustrative in nature and not restrictive.

A principal object of the present disclosure is dynamically leaning in a rhythmic and coordinated manner relative to the tilt and rotation of the platform so as to achieve a sustained and controlled rotation.

Figure 1:
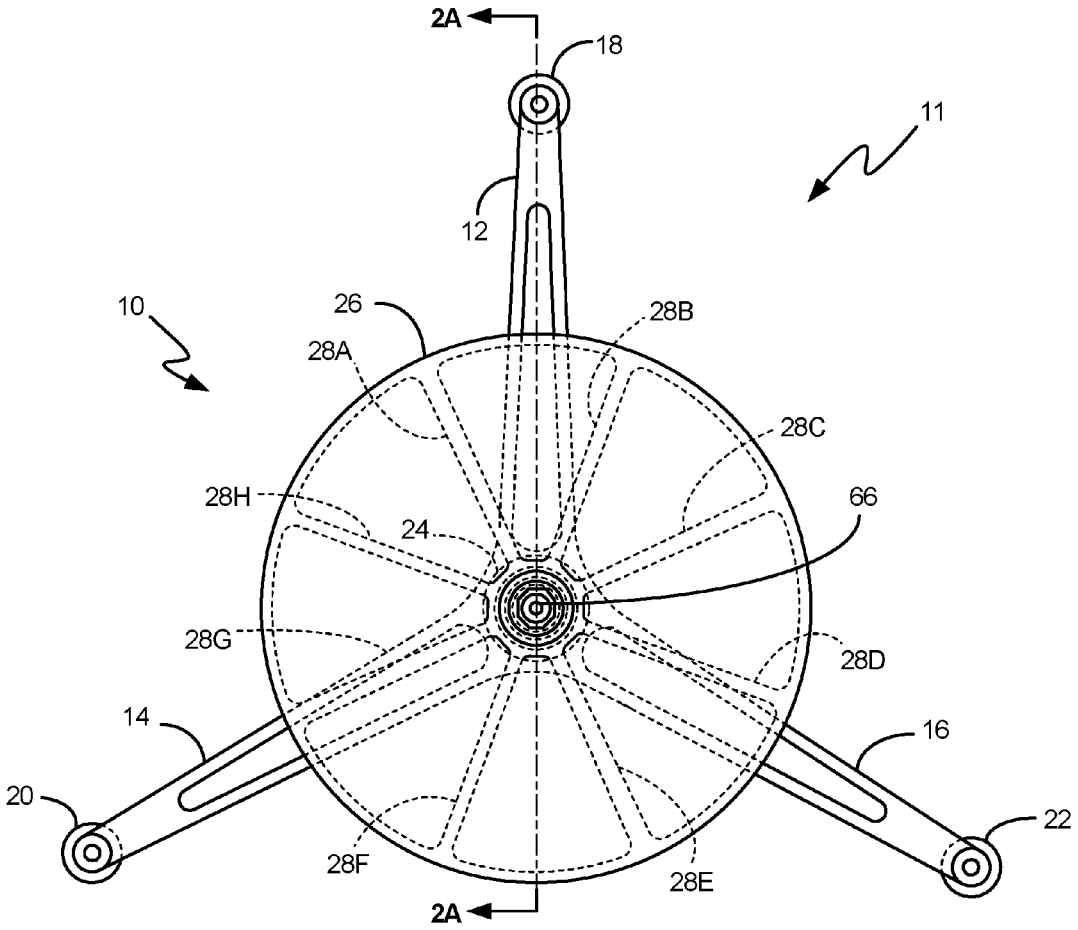
FIG. 1 is a top view schematic of one embodiment of the system.

While the various embodiments disclosed and contemplated herein are amenable to various modifications and alternative forms, specific embodiments have been shown by way of example in the drawings and are described in detail below. The intention, however, is not to limit the disclosure to the particular embodiments described. On the contrary, the various embodiments are intended to cover all modifications, equivalents, and alternatives falling within the scope of the those embodiments as defined by the appended claims.

DETAILED DESCRIPTION

The disclosed devices, systems and methods describes devices, systems and methods for balance, exercise, mental and physical health and entertainment relating to the use of a rotating platform. Embodiments of the devices, systems and methods disclosed herein can be described variously for brevity. Accordingly, it is to be understood that the use of any such term is in no way exclusive, such that the word "system" will also connote the underlying apparatus and methods.

Certain embodiments of the disclosed devices, systems and methods relate to the acquisition and practice of a centrifugal balance process, skill and ability. Centrifugal balance is the complex task of dynamically balancing the body's own weight against the pull of centrifugal force about an axis of rotation which is substantially similar to the axis of the user's own body, or within the bounds of one's body. In certain embodiments, the practice of the system, use of the device and associated methods relate to this novel skill, both in teaching and learning.

I. The Bio-Applied Rotational Physics Centrifugal Balance Platform and System An exemplary embodiment of the system is shown in FIG. 1. FIG. 1 is a schematic top view showing certain components of exemplary embodiments of the rotation and balance system 10. As shown in FIG. 1, various embodiments of the rotation and balance system has a base 11 that comprises a plurality of legs 12, 14, 16 set at equal angles from one another. While the use three legs 12, 14, 16 has been shown to have certain benefits described herein, other leg configurations can be utilized. At the distal end of each leg, certain embodiments further comprise feet 18, 20, 22. In certain implementations, the plurality of legs will form a regular geometric shape, such as an equilateral triangle.

Figure 2A:
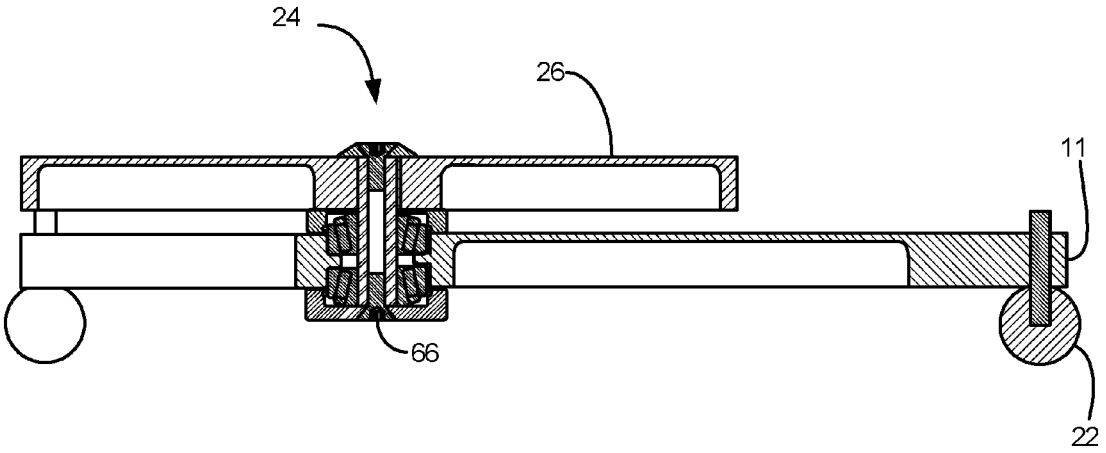
FIG. 2A is a side view schematic of the embodiment of FIG. 1.
Figure 2B:
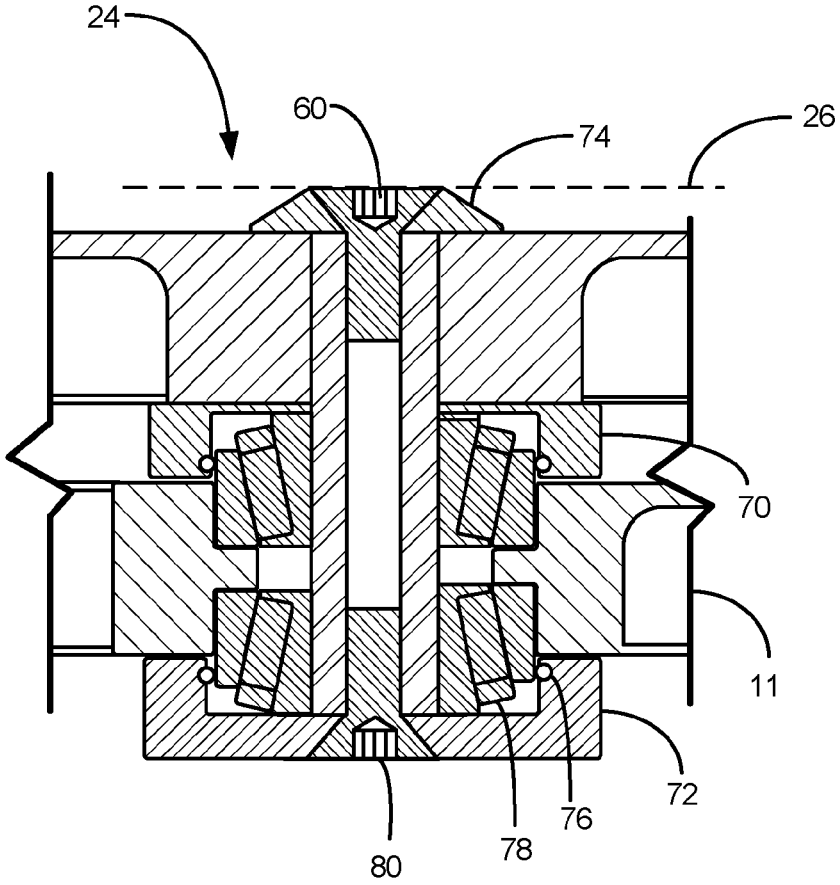
FIG. 2B is a close-up side view schematic of the rotational hub of the embodiment of FIG. 1.
Figure 3:
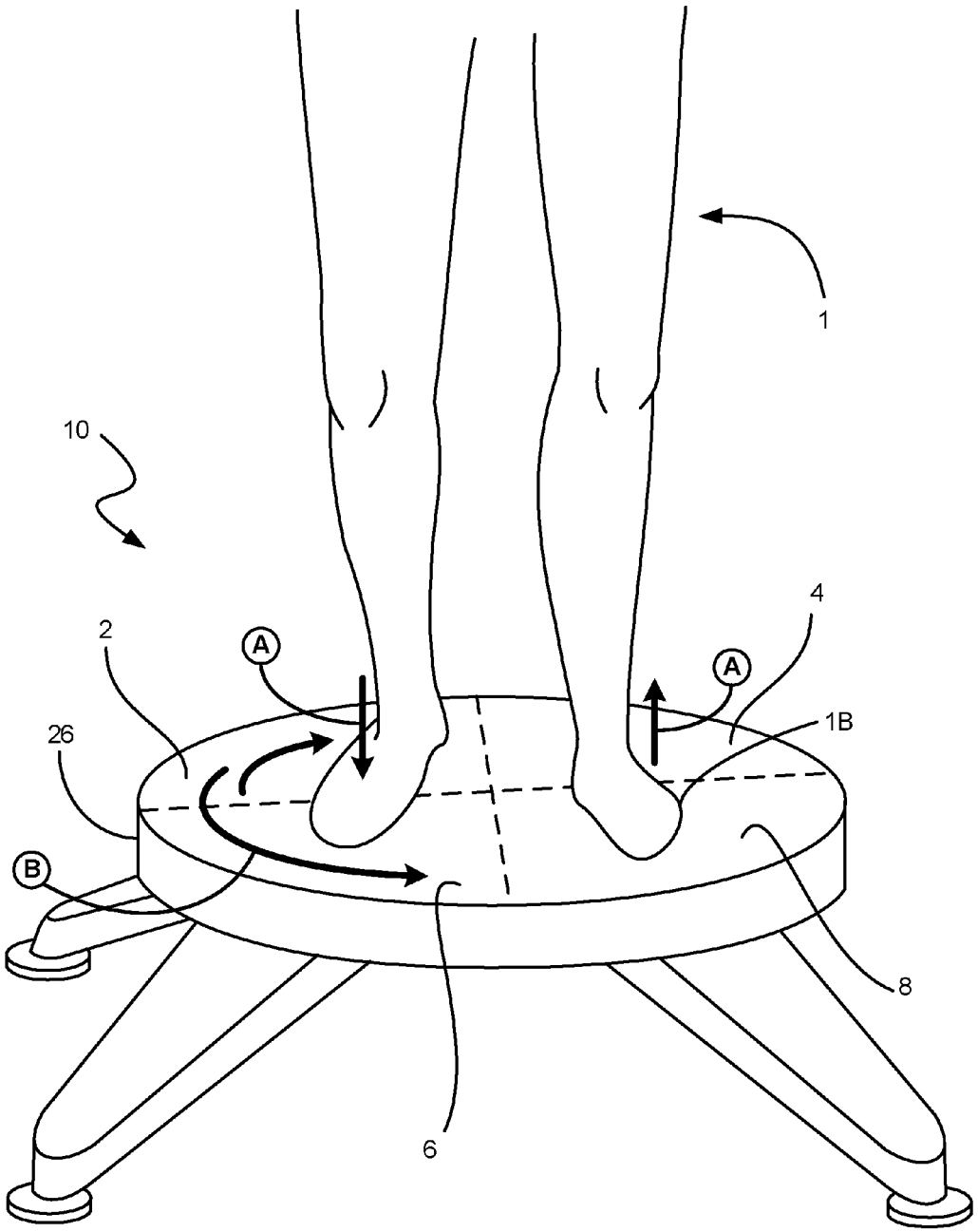
FIG. 3 is a front view of an application of the system, according to an exemplary embodiment.

At the proximal end, the base 11 by way of the legs 12, 14, 16 is joined at a central hub 24, which is depicted further in reference to FIGS. 2A-3.

Another aspect of the rotation and balance device shown in FIG. 1 is a rotating platform 26, wherein the central hub 24 is operationally connected to the rotating platform such that the platform 26 may spin freely relative to the fixed location of the legs and base 11. While FIG. 1 depicts a generally circular rotating platform 26, it would be apparent to one of skill in the art that other configurations, such as rectangles, pentagons, and other n-sided shapes are possible. In certain embodiments, independent platforms can be used and connected to the central hub independently. In certain exemplary embodiments, the shape formed by the distal end of the legs 12, 14, 16 will substantially circumscribe the rotating platform 26, so as to provide for ideal weight distribution, stability and economy of size, amongst other advantages. In exemplary embodiments, it has been found to be highly beneficial that the circumference created by the placement of the feet 12, 14, 16 of the base is substantially greater than the circumference of the platform 26. While this base circumference must not be significantly greater than the platform circumference, increased stability and balance of the platform in operation is achieved by such embodiments.

In certain implementations, substantially foot-shaped indentations may be imprinted or otherwise set into the rotating platform 26. In certain embodiments, reinforcing struts 28A, 28B, 28C, 28D, 28E, 28F, 28G, 28H can be placed on the underside of the rotating platform to enhance the overall strength of the rotation and balance device and platform. Further, a variety of materials, such as steel, aluminum, iron, plastic, wood, and the like can be utilized in production of the rotating platform and/or legs. As would be apparent to one of skill in the art, many materials and configurations are possible.

Turning to FIGS. 2A-2B, a principle aspect of the rotation and balance system is a nonzero offset of the rotating platform from the horizon established by the feet. In certain implementations this is achieved, by adjusting the relative height of the legs 12, 14, 16 or feet, 18, 20, 22 so as to establish a certain pitch, for example two degrees, from an absolute gravitational horizon. In certain embodiments the central hub 24 can be fitted such that the brace or support that it provides for the rotating platform 26 is in a plane that is at a certain nonzero angle from the gravitational horizon. As would be clear to one of skill in the art, other methods for establishing the nonzero angle are possible, such as adjustable shims or screws fitted below the hub 24 or on the feet 18, 20, 24 so as to introduce the nonzero angle, or "tilt."

In the embodiment best depicted in FIG. 2B, the central hub 24 further comprises a central axis 66, plurality of seals or caps, including a top cap 70, a bottom cap 72, a top cap flange 74, at least one O-Ring 76, a tapered roller bearing 78, and a hexagon socket flat countersunk head cap screw 80.

Turning to the system in use, FIG. 3 shows the rotation and balance system 10 in use by at least one user 1. The user 1 places their feet 1A on the rotating platform 26, and is then able to generate angular momentum by shifting the user's weight to a specific area of a foot (as shown by the arrows labeled A). By way of example, in certain implementations, the user's feet can be described as four distinct pressure points, right toe, right heel, left heel and left toe. By cycling the application of the user's weight between these four pressure points, the linear force applied to the rotating platform is translated into angular momentum (depicted as arrow B) on the platform 26 through the central hub's nonzero horizontal pitch. As such, the user 1 is able to generate rotational motion by applying their weight selectively to the rotating platform. In certain embodiments, this will take the form of a dynamic leaning motion on the part of the user over time.

II. Alternative Embodiments

Figure 4A:
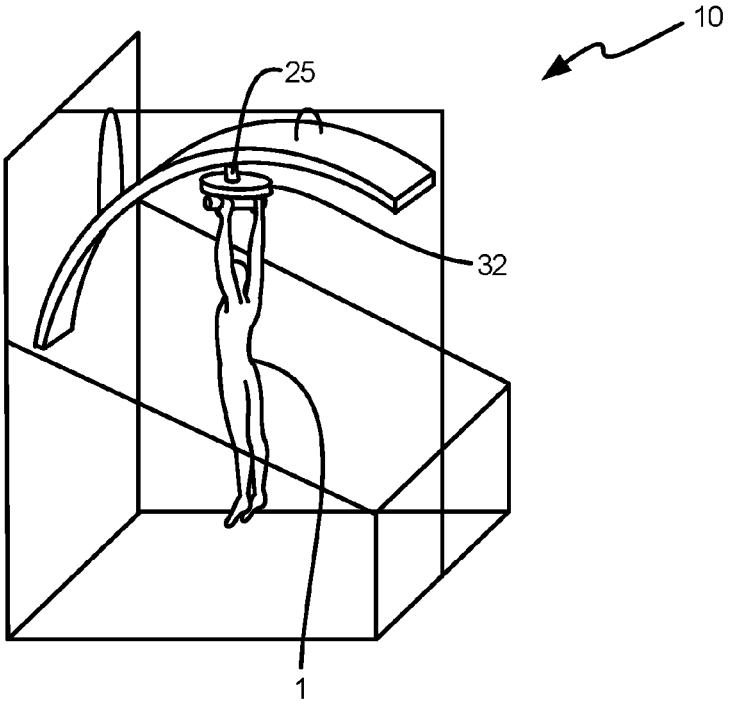
FIG. 4A is a perspective view of an alternate embodiment of the system comprising a hanging bar.
Figure 4B:
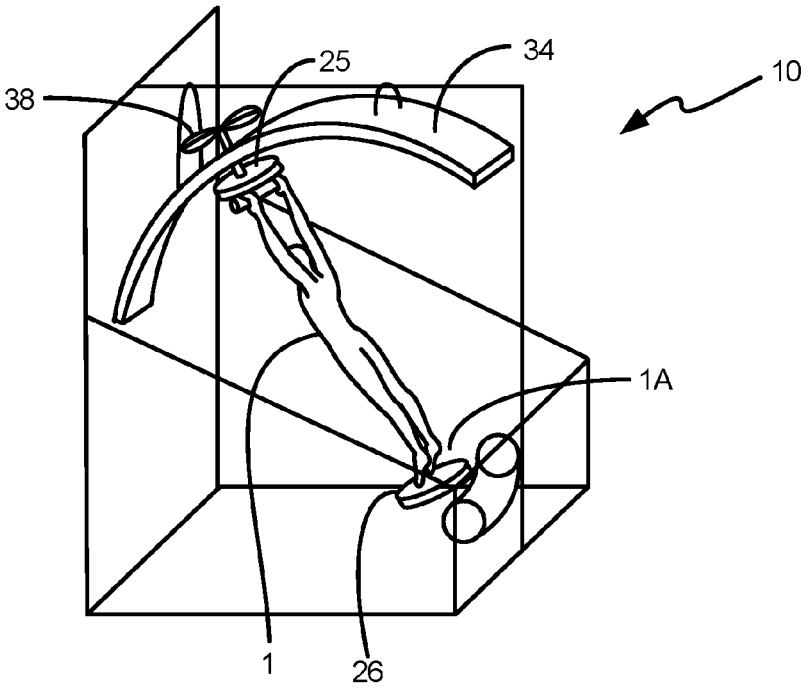
FIG. 4B is a perspective view of yet a further alternate embodiment of the system, wherein the hanging bar is offset.

As is depicted in FIG. 4A-4B, in certain other embodiments, the rotating platform can be replaced with a rotating bar mounted at a nonzero angle from the central hub and the legs. In certain implementations, the axis of rotation is then mounted to a ceiling or roof, so that the user 1 can perform the same action, but in a hanging position. Certain of these hanging embodiments 30 comprise an over-mounted rotating bar 32. In certain of these embodiments, the rotating bar may be adjusted from absolute horizon by way of a frame or other apparatus 34, and as such be locked at any angle between horizontal and vertical (as shown in FIG. 4B). In these embodiments, the user 1 is in operational communication with the central hub 25 so as apply force to the bar 32 so as to induce a spinning rotation about the central hub 25.

In these embodiments, rotation is achieved by coordinated pulling on the top bar 32. This is intended to be a full-body strength trainer that works the entire muscular sheath of the torso and limbs without the spinal compression that comes from lifting heavy weights. It is a principle object of the system to aid the user in acquiring the necessary strength and coordination to maintain centrifugal balance at faster speeds.

In certain of these embodiments of the system, an embodiment of the rotation platform 26 is also provided for operation by way of, or rest for, the user's feet 1A.

In certain of these embodiments, the rotation of the central hub is "loaded," or otherwise resisted by physical means, such as by coupling the central hub 25 to a fan blade 38, rubber band (not shown), or other means of introducing rotational resistance in an exercise device.

Figure 5:
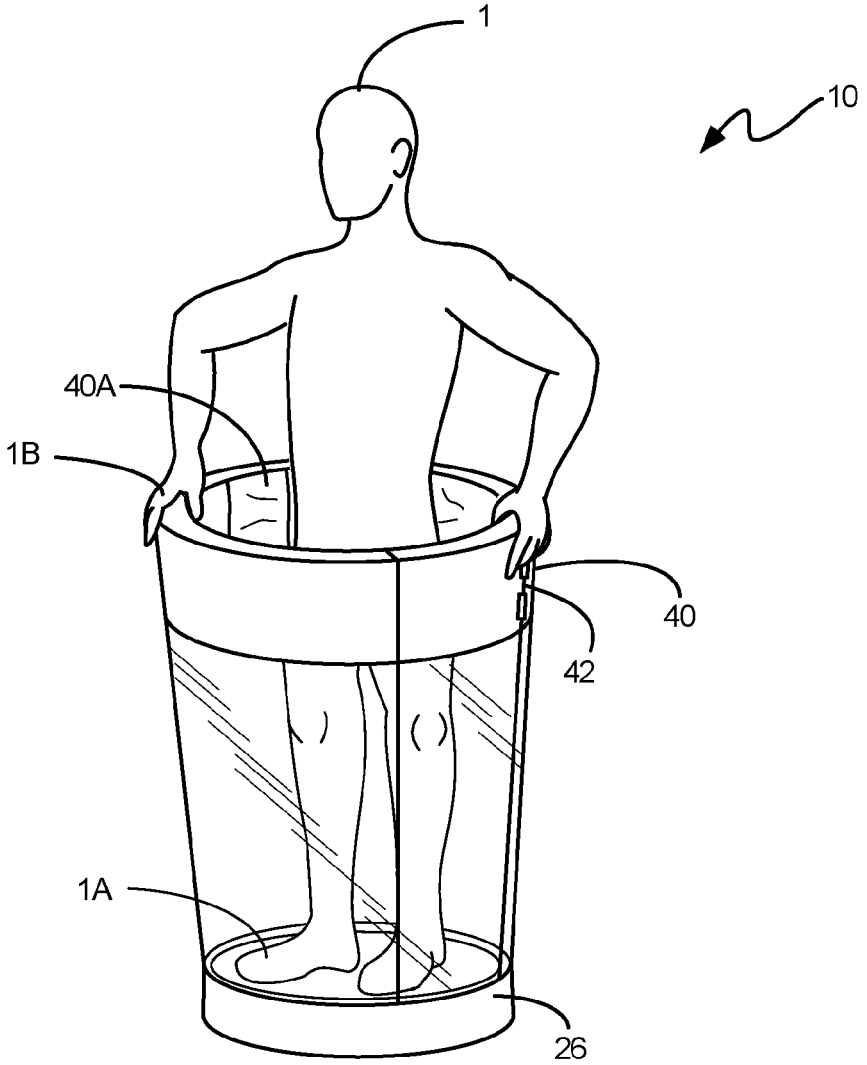
FIG. 5 is a perspective view of an exemplary embodiment of the system comprising a supporting structure.

Certain exemplary embodiments of the system further comprise a stability configuration 40. FIG. 5 depicts an example of such an embodiment of the system 10. In certain of these embodiments, in addition to the device, the system further comprises a support bar or "bucket" 40, which is in rotational communication with the platform 26 so as to provide the user 1 with added support and prevent accidental dismount from the platform 26. In further embodiments, the stability configuration is stationary relative to rotation of the platform 26.

A principle object of these embodiments is to provide a further breadth of uses for the system 10, such as for training, rehabilitative, or other entry-level uses, including for use by users with disabilities or other impediments to balance on the platform 26. In certain applications, the maximum rotational speed possible is limited or otherwise restricted so as to provide additional security and safety for users. Further embodiments also feature padding 40A, or other additional safety measures (as is shown in FIG. 5)

In certain of these embodiments, the stability configuration 40 may further comprise a hatch 42 or other means of entry and exit, such as a latchable door or other entryway, which is configured to be latched or locked in place for operational use. In certain of these embodiments, the stability configuration 40 is also in operational communication with the central hub (as described in reference to FIGS. 1-3) so as to allow the user to power the rotation of the platform 26 manually by way of the user's hands 1B, in addition to leaning or other applications of force by way of the feet 1A.

Figure 6:
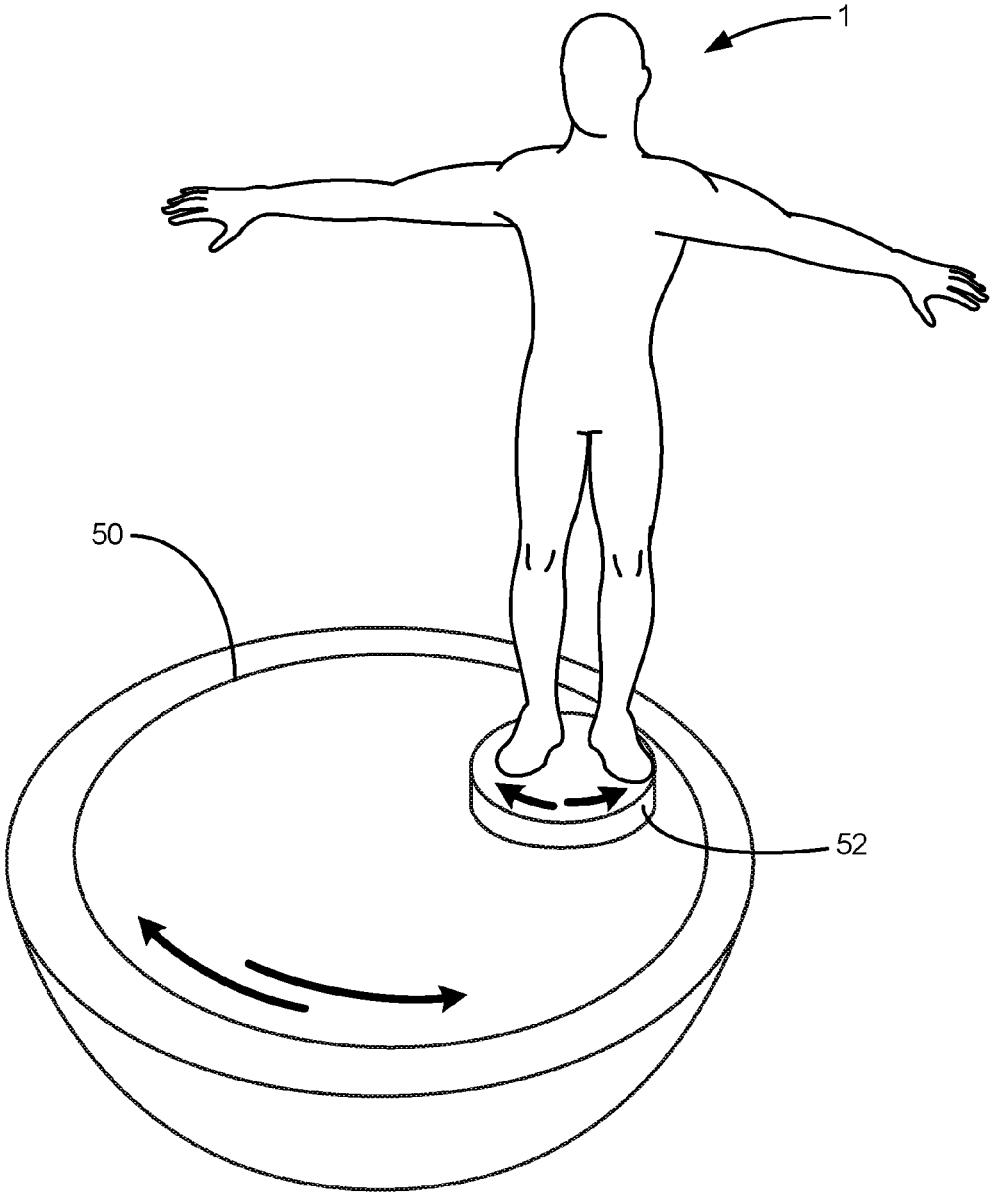
FIG. 6 is a perspective view of an alternate embodiment of the system comprising a plurality of rotating surfaces.

As is depicted in FIG. 6, further embodiments of the system comprise a plurality or rotating platforms 50, 52. In exemplary embodiments, a first rotating platform 50 is provided which further contains a second rotating platform 52 of reduced sized relative to the first rotating platform and mounted such that the circumference of the first rotating platform 50 fully encircles the diameter of the second rotating platform 52, and that the two platforms 50, 52 are not coaxial. Both platforms 50, 52 further comprise rotating hubs (not shown, but as described in reference to FIGS. 1-3)

such that both are capable of being induced to rotate by the alternating application of force to various regions of the platform 50, 52.

In use, these embodiments are generally operated by the user in the manner described above, however, the user may initiate movement on either of the platforms 50, 52 and switch foot positions between the platforms 50, 52.

Figure 7:
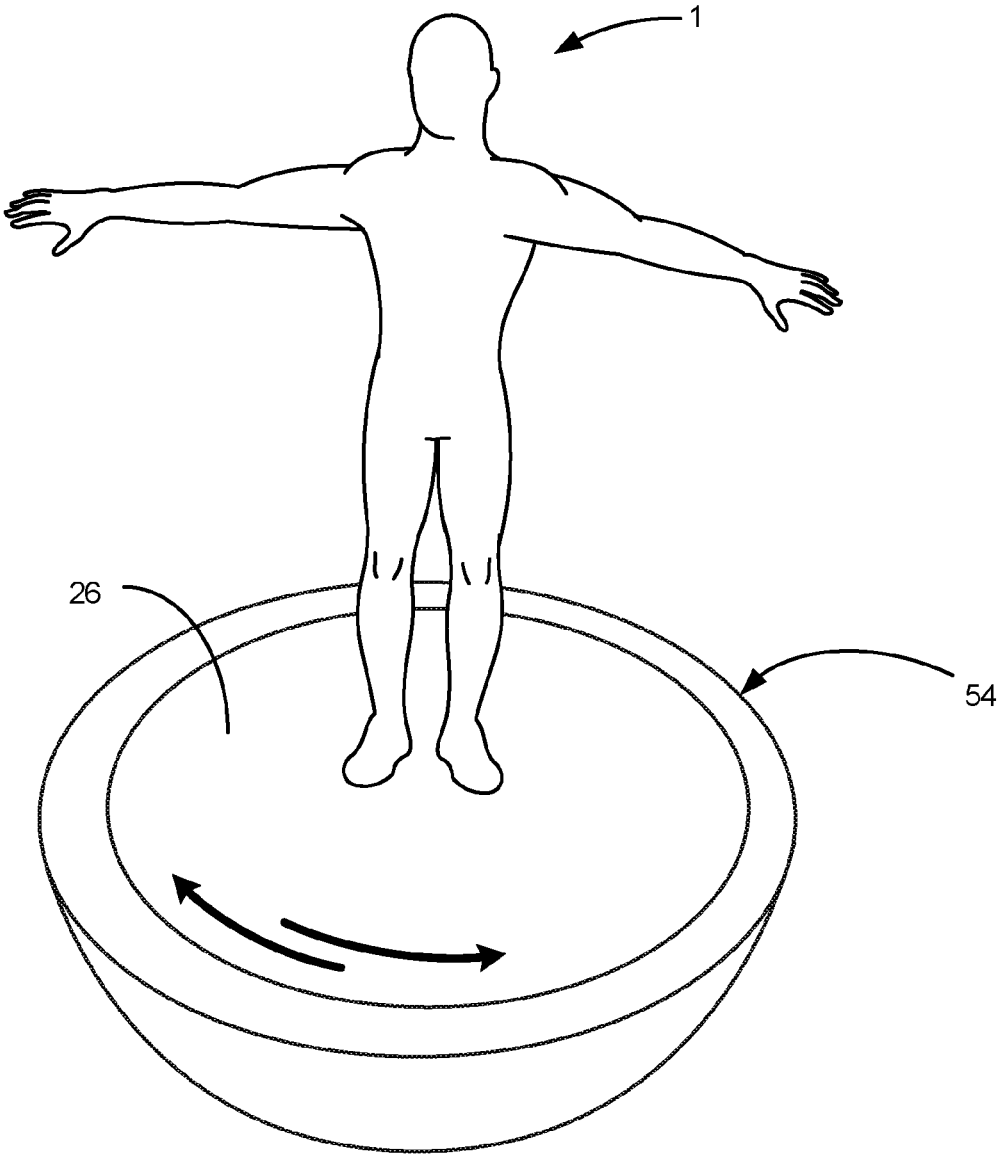
FIG. 7 is a perspective view of an alternate embodiment of the system comprising a rounded base.

In various embodiments, and as shown in FIG. 7, the base may be a hemisphere, rather than a plurality of legs. Operation and use in these embodiments is achieved in a substantially similar fashion to the operation of the platform in FIG. 3, however in these embodiments the non-zero angle is introduced by the hemispheric base 54, rather than the leg configuration of central hub as described in reference to FIG. 3, for example. Critically, in these embodiments the non-zero angle is dynamic, rather than static.

Figure 8A:
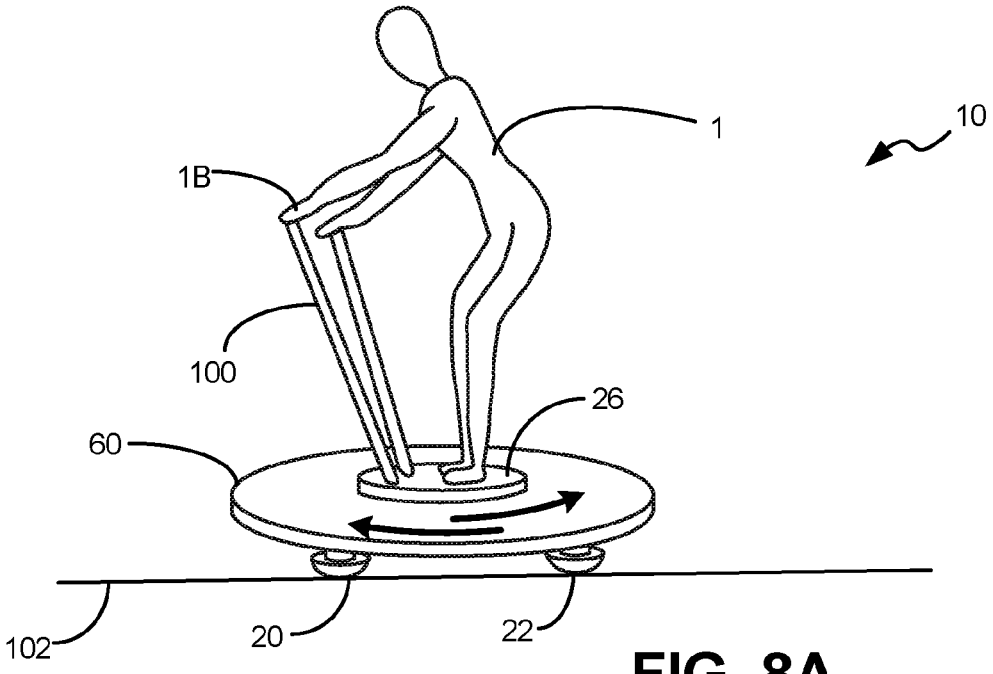
FIG. 8A is a perspective view of an alternate embodiment of the system comprising a handle portion.
Figure 8B:
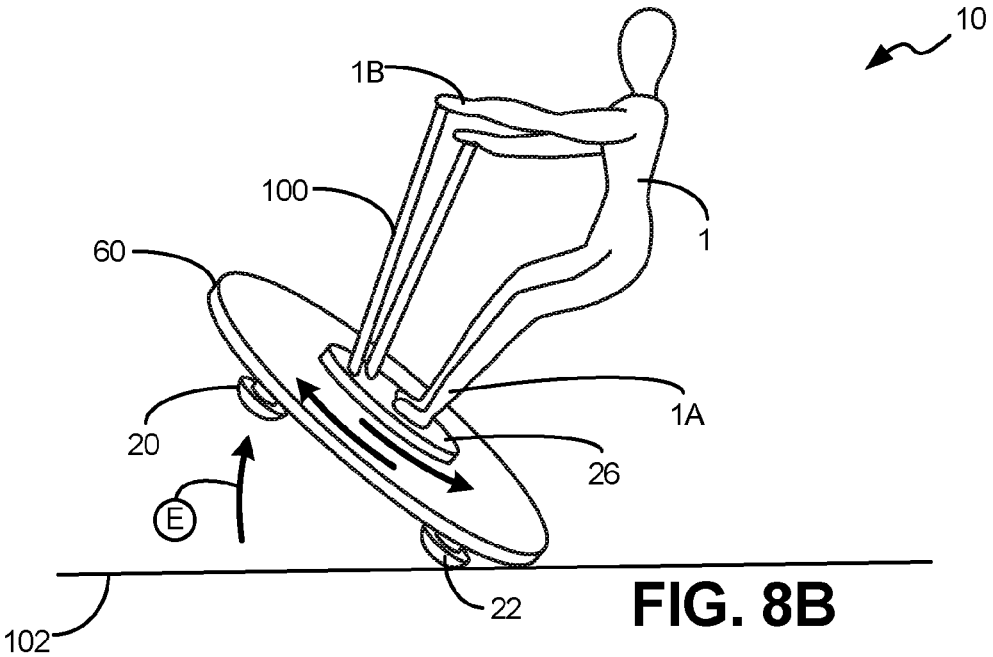
FIG. 8B is a perspective view of the embodiment of FIG. 8A showing the system in use.

FIGS. 8A-8B depict a further embodiment of the system 10. In these embodiments, the user 1 employs his or her own body weight as counterballast so as to tilt the platform 26 on to the edge of a large circular base 60, so as to induce angular momentum about that base 60. In these embodiments, the platform 26 and base 60 are in rotational communication about the central hub, such that base itself 60 lifts off of the horizon 102, such that at least one of the legs 20 is no longer in contact with the horizon 102 (as is depicted by the arrow at E). In these embodiments, the user feet 1A remain in operational communication with the platform 26, as described elsewhere herein. In further embodiments, and as depicted in FIG. 8B, the system further comprises at least one handle 100 for operation by way of the user hands 1B.

In these embodiments, underside of the base 60 is fitted with a leg configuration 20, 22 which allows the main platform 26 to sit flat, or at a low tilt. Affixed to the big platform is a smaller rotating disk (that could be centered, or off-center) that the user stands on. Affixed to, and rotating with this interior platform 26 are handles 100 for the user to hold 1B and use for balance as he or she shifts his weight around and thereby causes the base 60 to roll around on its outer edge.

Prerequisite to successful use of this embodiment is the ability to achieve and maintain centrifugal balance, and proprioceptive orientation within a spin.

Although the disclosed devices, systems and methods has been described with reference to preferred embodiments, persons skilled in the art will recognize that changes may be made in form and detail without departing from the spirit and scope of the invention.

Various modifications and additions can be made to the exemplary embodiments discussed without departing from the scope of the present disclosure. For example, while the embodiments described above refer to particular features, the scope of this invention also includes embodiments having different combinations of features and embodiments that do not include all of the described features. Accordingly, the scope of the various embodiments is intended to embrace all such alternatives, modifications, and variations as fall within the scope of the claims, together with all equivalents thereof.

What is claimed is:

1. A device for rotating a user requiring centrifugal balance, comprising:

a. a base comprising at least three legs disposed radially and configured to be placed on a floor at a horizon, each of the at least three legs comprising a distal leg end and a proximal leg end, wherein the distal leg ends define a base circumference;

b. a central hub adjoining the proximal leg ends, the central hub comprising a central axis; and c. a substantially disc-shaped rotating platform comprising a top surface, the platform being supported by the base and in rotational communication with the central hub, the substantially disc-shaped rotating platform defining a platform circumference, wherein:

i. the base circumference is greater than the platform circumference, such that the distal leg ends extend beyond the platform circumference and substantially circumscribes the substantially disc-shaped rotating platform, ii. the central hub is configured to dispose the platform at a non-zero angle from the horizon, and iii. the platform is configured to be capable of being directionally rotated relative to the base by the selective application of the weight of the user to the platform by way of the toes and heels of the user.

2. The device of claim 1, further comprising a plurality of feet disposed at the distal ends of each of the at least three legs.

3. The device of claim 2, wherein the plurality of feet are disposed outside the platform circumference.

4. The device of claim 1, wherein the nonzero angle is about 2°.

5. A method of improving centrifugal balance in a user, comprising:

a. placing a device for rotating the user on a floor, the device comprising:

i. a base comprising at least three legs disposed radially and configured to be placed on a floor at a horizon, each of the at least three legs comprising a distal leg end and a proximal leg end, wherein the distal leg ends define a base circumference;

ii. a central hub adjoining the proximal leg ends;

iii. a substantially disc-shaped rotating platform supported by the base in rotational communication with the central hub, comprising a top surface and defining a platform circumference, wherein:

i. the base circumference is greater than the platform circumference, such that the distal leg ends extend beyond the platform circumference and substantially circumscribe the platform, and ii. the central hub is configured to dispose the platform at a non-zero angle from the horizon;

b. applying pressure to the platform by cyclically applying linear force to the top surface of the rotating platform so as to produce a rotational motion around the central hub and base.

6. The method of claim 5, wherein the linear force is applied by the foot of the user to the high region of the platform.

7. A non-zero rotation balance system for use on a floor in centrifugal balance training by a user, comprising:

a. a central hub comprising a rotation mechanism;

b. a base comprising:

i. a first elongate leg comprising a first leg proximal end, a first leg distal end and a first foot disposed at the first leg distal end;

ii. a second elongate leg comprising a second leg proximal end, a second leg distal end and a second foot disposed at the second leg distal end; and iii. a third elongate leg comprising a third leg proximal end, a third leg distal end and a third foot disposed at the third leg distal end, wherein the first proximal leg end, second proximal leg end and third proximal leg end are fixedly attached to the central hub, wherein the first leg distal end, second leg distal end and third leg distal end are disposed radially at approximately 120° from the central hub to define a base circumference, wherein the first foot, second foot and third foot define a base plane on the floor, and wherein at least one of the first foot, second foot and third foot is adjustable; and c. a substantially circular rotating platform comprising a top surface and rotatably attached to the central hub opposite the base at a non-zero angle from the base plane, wherein:

i. the non-zero angle is introduced by the at least one adjustably foot, and ii. the top surface comprises:

A. a first quadrant;

B. a second quadrant;

C. a third quadrant; and

D. a fourth quadrant.

8. The system of claim 7, wherein the rotating platform is configured to be directionally rotated relative to the base by selectively applying pressure to the top surface of the platform in the first quadrant, second quadrant, third quadrant and fourth quadrant so as to induce angular momentum and rotation of the platform.

9. The system of claim 8, wherein the rotation of the platform around the central hub is capable of sufficient speed to require centrifugal balance for the user to stay mounted.

10. The system of claim 9, wherein the system is configured to generate centrifugal force about an axis of rotation which is substantially similar to the axis of the body of the user.

11. The system of claim 9, further comprising a stability configuration.

12. The system of claim 9, further comprising a second rotating platform disposed within the rotating platform.

13. The system of claim 9, wherein the base further comprises a plurality of reinforcing struts.

14. The system of claim 9, wherein at least two independent platforms can be used and connected to the central hub independently.

* * * * *